US007509233B2

(12) United States Patent
Pervaiz

(10) Patent No.: US 7,509,233 B2
(45) Date of Patent: Mar. 24, 2009

(54) DIAGNOSTICS FOR IDENTIFYING A MALFUNCTIONING COMPONENT IN AN AIR COMPRESSOR SYSTEM ONBOARD A LOCOMOTIVE

(75) Inventor: Muhammad Pervaiz, Erie, PA (US)

(73) Assignee: General Electric Company, Schenectady, NY (US)

( * ) Notice: Subject to any disclaimer, the term of this patent is extended or adjusted under 35 U.S.C. 154(b) by 708 days.

(21) Appl. No.: 11/054,449

(22) Filed: Feb. 9, 2005

(65) Prior Publication Data

US 2005/0220628 A1 Oct. 6, 2005

Related U.S. Application Data

(60) Provisional application No. 60/543,084, filed on Feb. 9, 2004.

(51) Int. Cl.
*G06F 11/30* (2006.01)
*G06F 15/00* (2006.01)
*G21C 17/00* (2006.01)

(52) U.S. Cl. ..... 702/183; 702/131; 702/189; 73/168; 701/19; 701/36; 417/231

(58) Field of Classification Search ..... 702/113, 702/138, 140, 183, 189; 73/168; 701/19, 701/36; 417/231
See application file for complete search history.

(56) References Cited

U.S. PATENT DOCUMENTS

| | | | | |
|---|---|---|---|---|
| 3,872,711 | A * | 3/1975 | Atkinson et al. | 73/39 |
| 5,106,270 | A | 4/1992 | Goettel et al. | |
| 5,446,389 | A * | 8/1995 | Lenz | 324/555 |
| 5,623,834 | A | 4/1997 | Bahel et al. | |
| 5,894,881 | A | 4/1999 | Wagner et al. | |
| 6,027,311 | A | 2/2000 | Hill et al. | |
| 6,102,665 | A | 8/2000 | Centers et al. | |
| 6,447,267 | B1 | 9/2002 | Varney et al. | |
| 6,599,103 | B2 | 7/2003 | Finnamore et al. | |
| 6,609,899 | B1 | 8/2003 | Finnamore | |
| 6,651,034 | B1 * | 11/2003 | Hedlund et al. | 702/183 |
| 6,659,739 | B2 | 12/2003 | Varney et al. | |
| 6,666,093 | B2 | 12/2003 | Morganti | |

* cited by examiner

*Primary Examiner*—Edward Raymond
*Assistant Examiner*—Elias Desta
(74) *Attorney, Agent, or Firm*—John Kramer, Esq.; Enrique J. Mora, Esq.; Beusse Wolter Sanks Mora & Maire, P.A.

(57) ABSTRACT

A method and computer program product for identifying one or more malfunctions in a locomotive air compressing system is provided. Some of the malfunctions may be correctable onboard a locomotive, and constitute onboard serviceable malfunctions, while the remaining of the malfunctions may only be correctable with the air compressing system being uninstalled and serviced at an off-board servicing site, such malfunctions constitute off-board serviceable malfunctions. The method allows monitoring responses indicative of a malfunction type that may be associated with at least with one of the following: a corrective action that may be performed onboard the locomotive, and a corrective action that may only be performed off-board the locomotive.

18 Claims, 4 Drawing Sheets

DIAGNOSTICS FOR IDENTIFYING A MALFUNCTIONING COMPONENT IN AN AIR COMPRESSOR SYSTEM ONBOARD A LOCOMOTIVE

This application claims priority to a provisional application filed on Feb. 9, 2004, having application No. 60/543,084, which is incorporated herein by reference.

BACKGROUND OF THE INVENTION

It is known to use multi-cylinder air compressors on freight and passenger locomotives to supply compressed air to various locomotive systems, such as the operating and control equipment of a railway air brake system. Prior art techniques for servicing the air compressor system have essentially required uninstalling and shipping major components of the air compressor system, such as the entire compressor, to a specialized compressor servicing site. This approach may lead to unnecessary costs and delays, if the type of component causing the malfunction was one that could be replaced in-situ at the locomotive (i.e., as installed onboard the locomotive) without having to incur the delays and expenses associated with shipping the entire compressor to the specialized servicing site. However, heretofore there was no effective procedure or test apparatus to diagnose locomotive air compressors in-situ to determine if the malfunction was due to an in-situ serviceable component or to a cause that required removal of the air compressor system and servicing off-board of the locomotive.

BRIEF DESCRIPTION OF THE DRAWINGS

The features and advantages of the present invention will become apparent from the following detailed description of the invention when read with the accompanying drawings in which.

DETAILED DESCRIPTION OF THE INVENTION

The inventor of the present invention has innovatively recognized a sequence of diagnostics techniques that may be performed in-situ onboard a locomotive for identifying in a locomotive air compressor system (out of various components that make up such a system) a specific malfunctioning component that is likely to require a servicing action and further identifying a type of servicing action appropriate for correcting the malfunction. This type of technique is particularly advantageous in the locomotive industry since now one may be able to replace certain identified components in-situ on the locomotive while at a generic or non-specialized locomotive service shop without having to uninstall and ship main components of the compressor system for servicing at a specialized suppliers site. This is a significant improvement over prior art techniques that have essentially required uninstalling and shipping major components of the air compressor system, such as the compressor, regardless of whether in fact there is ultimately determined to be a need for such specialized servicing. For example, a cylinder head including intake and outlet valves could be replaced at the generic service shop without having to uninstall and ship the entire compressor to the specialized suppliers site. Below is a description of an exemplary compressor air system that may benefit from the diagnostics techniques embodying aspects of the present invention.

Figure 1:
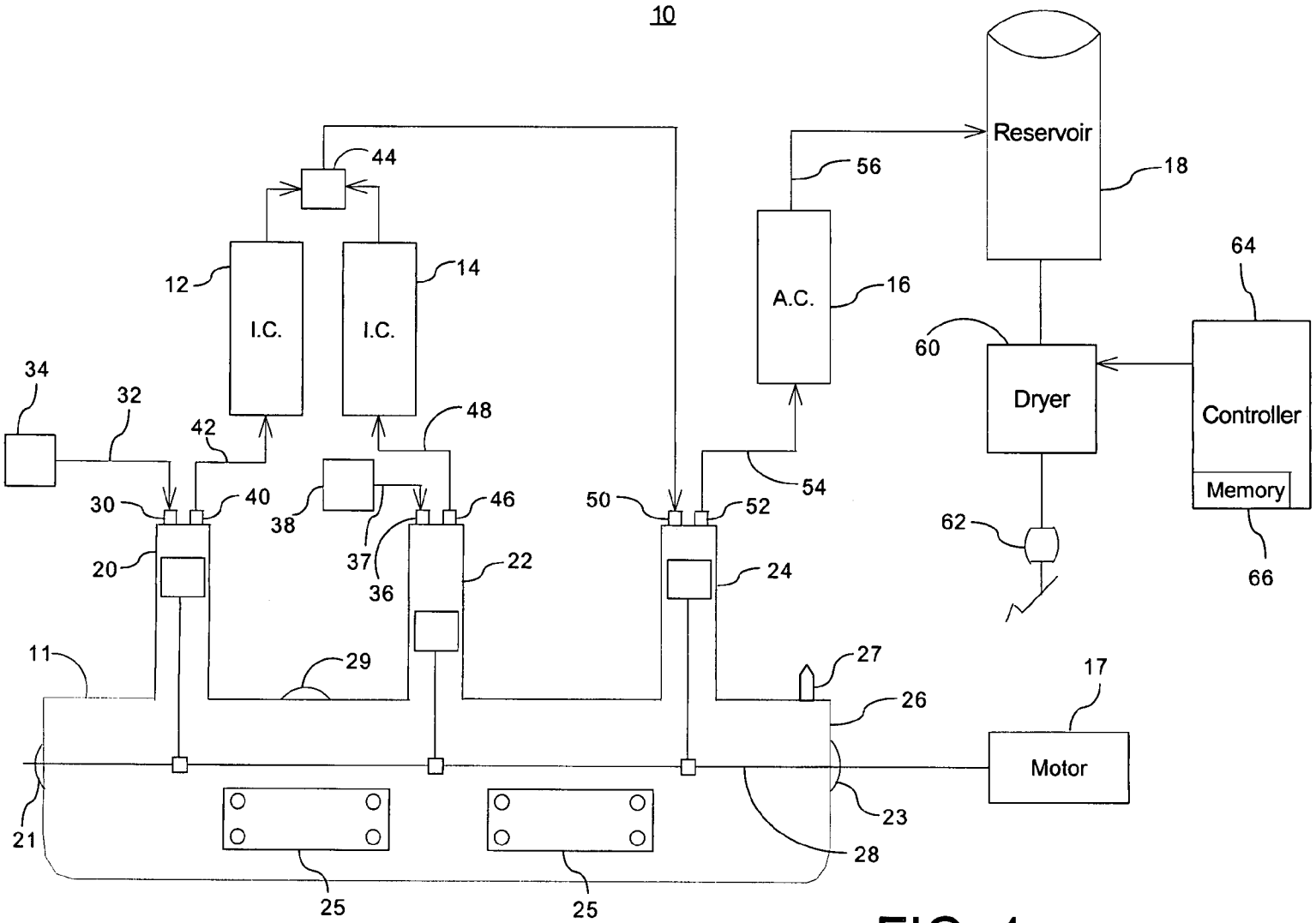
FIG. 1 illustrates a schematic representation of an exemplary locomotive air compressor system that benefits from aspects of the present invention.

FIG. 1 shows an air compressor system 10, including a pair of intercoolers 12 and 14, an aftercooler 16, a main storage reservoir 18, and associated piping. In one exemplary embodiment air compressor system 10 comprises a multi-cylinder, two-stage, air-cooled compressor having a first low pressure cylinder 20 and a second low pressure cylinder 22 and a high pressure cylinder 24, each of which may be provided with cooling fins. As shown, the pair of low pressure cylinders 20 and 22 and the high pressure cylinder 24 may be mounted on and supported by a crankcase 26 in the usual manner and include respective pistons which are actuated by connecting rods driven by a rotatable crankshaft 28. In one exemplary embodiment the crankcase 26 includes a breather valve 27 and an oil-fill plug 29. One end of the crankshaft 28 may be coupled to and driven by a suitable rotatable prime mover, such as an electric motor 17 or the like, while the other end of the crankshaft 28 may be attached to a rotary cooling fan assembly (not shown). Crankcase seals 21 and 23 are commonly employed to seal both ends of the crankshaft 28 to prevent leakage of lubricating fluid. One or more side removable covers 25 may be provided to provide access to the interior of the crankcase 26.

An inlet valve 30 of the low-pressure cylinder 20 is connected by conduit 32 to an intake filter 34, while an inlet valve 36 of the low-pressure cylinder 22 is connected by conduit 37 to an air intake filter 38. An outlet valve 40 of the low-pressure cylinder 20 is connected to an inlet header of the first intercooler 12 via a pipe 42. It will be appreciated that although FIG. 1 illustrates just one inlet and outlet valve per cylinder head assembly, in one exemplary embodiment, each cylinder head assembly may comprise a pair of inlet and outlet valves per cylinder head. Typically, the valves may be spring-loaded valves responsive to negative or positive pressure to reach either a closed or an open condition.

An outlet header of intercooler 12 is connected to one inlet of a T-pipe fitting 44. Similarly, an outlet valve 46 of the low pressure cylinder 22 is connected to an inlet header of the second intercooler 14 via a pipe 48. An outlet header of intercooler 14 is connected to the other inlet of the T-pipe fitting 44, while the outlet of the T-pipe fitting 44 is connected to an inlet valve 50 of the high pressure cylinder 24. An outlet valve 52 of high pressure cylinder 24 is connected by suitable conduits and fittings forming piping 54 to an inlet header of the aftercooler 16. An outlet header of aftercooler 16 is connected by suitable conduits and fittings forming piping 56 to the inlet of the main storage reservoir 18.

Below is a description of an exemplary sequence of tests for identifying in a locomotive air compressor system any of various components that are likely to require a servicing action that, for example may performed in-situ onboard the locomotive or at an specialized compressor servicing site based on the results of the performed test sequence.

Crankcase Inspection Test:

Evacuate oil from crankcase and then remove side covers 25 and inspect the interior of the crankcase 26, e.g., bearings and lubrication system. For example, if one detects the presence of pieces of metal, or bad bearings, then a servicing decision would be to remove the compressor for an overhaul. If this upfront test is passed, one would reattach the side covers 25 and continue with the tests below.

Intercoolers and Low Pressure Cylinder Tests:

Test 1A (Pressurizing Intercoolers and One Of The Two Low Pressure Cylinders):

1. Remove air filters 34 and 38.
2. Remove oil-fill plug 29
3. Block breather valve 27
4. Block one of the intake conduits (e.g., the conduit 32 that provides an intake to one of the low pressure cylinders, e.g., low pressure cylinder 20).
5. Block the pipe that provides a discharge outlet to the aftercooler 16. That is, block pipe 56.
6. Install on the other intake conduit (e.g., conduit 37 that provides an intake to low pressure cylinder 22), a pressurizing fixture (e.g., including a pressure gage and valve).
7. Pressurize to a predefined pressure (e.g., 60 psi) and start to measure time, e.g., start a timer.
8. Record time elapsed upon reaching one or more predefined pressure levels, e.g., 55, 50, 45 and 40 psi pressure.
9. Compare the actual elapsed time recorded at the predefined pressure levels relative to predefined threshold times.
10. Check for possible air leak through intercoolers 12 and 14, e.g., visual check.
11. Check for possible airflow through oil-fill opening 29.

The predefined pressure (e.g., 60 psi) applied in step 6 above is sufficiently high to cause intake valve 36 to open and pressurize the low-pressure cylinder 22 as well as intercoolers 12 and 14. The predefined pressure is also sufficiently low to stay within the pressure ratings of the intercoolers 12 and 14 and avoid actuating the intake valve 50 of the high-pressure cylinder 22 to an open condition. At this point, presuming the outlet valve 40 is operating properly, the head of the low-pressure cylinder 20 has not been pressurized because the outlet valve 40 is in a closed condition in response to the applied pressure. Thus, one would perform another sequence of steps for pressurizing the head of the low-pressure cylinder 20. More specifically, Test 1B (Pressurizing Intercoolers and the Other One of Low Pressure Cylinders):

1. Block the other one of the intake conduits (e.g., conduit 37) that provides an intake to low-pressure cylinder 22).
2. Install on the other intake conduit (e.g., conduit 32 that provides an intake to low pressure cylinder 20), the pressurizing fixture
3. Pressurize to the predefined pressure (e.g., 60 psi) and start to measure time, e.g., start a timer.
4. Record time elapsed time upon reaching one or more predefined pressure levels, e.g., 55, 50, 45 and 40 psi pressure.
5. Compare the actual elapsed time recorded at the predefined pressure levels relative to predefined threshold times.
6. Check for possible air leak through intercooler 12 and 14, e.g., visual check
7. Check for possible airflow through oil-fill opening.

The foregoing sequence is essentially arranged for determining whether there is a leak in any (or both) of the intercoolers 12 and 14 and whether there is a leak in any of the low-pressure cylinder heads, such as air leaking by the piston rings of any of the low-pressure cylinder heads and into the crankcase. The inventor of the present invention has identified failure mode indications associated with respective components of the compressor system that may be observed during the test sequence. One key advantage of the present invention over prior art techniques is being able to accurately distinguish and identify the type of failure modes that may be corrected in-situ from those that will require removal of major equipment from the locomotive for servicing at the specialized servicing site. Occurrence of specific indications would point out to a likely malfunction in a given component. For example, intercooler leaks may be generally characterized as relatively slow leaks compared to a low-pressure cylinder wall leak. The presence of intercooler leaks may be determined by visual inspection and/or a relatively moderate depressurizing rate (e.g., if the elapsed time to reach 40 psi is approximately 15 seconds, this may be indicative of an intercooler leak). Intercooler leaks tend to be visually detectable since intercoolers that have been in operational use for some time tend to collect visually detectable debris in their interior.

In the event of a low-pressure cylinder wall leak, e.g., air passes into the crankcase from a respective one of the low-pressure cylinder heads, then one may be able to detect airflow through the oil-fill opening. This detection may be accomplished by monitoring the condition of a tape or other suitable thin flexible member placed over the oil-fill opening. In addition, service personnel may feel or hear such airflow. Moreover, a low-pressure cylinder wall leak tends to exhibit a higher depressurizing rate as compared to an intercooler leak. For example, while an intercooler leak may take about 15 seconds to reach 40 psi, a low-pressure cylinder wall leak may take just 5 seconds or less to reach 40 psi. The ability to determine the presence of an intercooler failure versus a cylinder wall failure is significant since the intercoolers may be readily replaced at the locomotive without having to remove the entire compressor whereas a cylinder leak into the crankcase typically requires removal of the entire compressor for an appropriate overhaul at a specialized service site.

It has been observed from test data that variation in the recorded elapsed times (indicative of different depressurizing rates) obtained during Tests 1A and 1B tend to indicate that the intercoolers 12 and 14 are functioning properly and that the cause of this variation is likely to be caused by some other malfunctioning component, but not the intercoolers. This follows since during Tests 1A and 1B both intercoolers represent an assembly tested in common during each test and thus variations that may arise in the recorded elapsed times would tend to point to a different failure mode, such as leakage in one of the low-pressure cylinder walls.

TEST 2—Aftercooler and High Pressure Cylinder Tests:

1. Open intake conduits to low-pressure cylinders 20 and 22.
2. Install pressurizing fixture at aftercooler discharge outlet. That is, pipe 56.
3. Pressurize to a predefined pressure, e.g., 80 psi and start to measure time, e.g., start a timer.
4. Record time elapsed upon reaching one or more predefined pressure levels, e.g., at 75, 70, 65 and 60 psi.
5. Compare the actual elapsed time recorded at the predefined pressure levels relative to predefined threshold times.
6. Check for possible air leak through aftercooler 16, e.g., visual check
7. Check for possible airflow through oil-fill opening.

One aspect of this test allows pressurizing the aftercooler 16 and determining the presence of a leak in the aftercooler. The presence of such a leak may be determined by visual inspection and/or a relatively moderate depressurizing rate (e.g., if the elapsed time to reach 60 psi is approximately 15 seconds, this may be indicative of an aftercooler leak. Another aspect of this test also allows determining a malfunction in the outlet valve 52 of the high-pressure cylinder 24. For example, if the outlet valve 52 is operating properly, then when the aftercooler 16 is pressurized through pipe 56, that valve should remain closed and the pressurization should be limited to the aftercooler 16. In the event of a leaky outlet valve 52 in the high-pressure cylinder, the head of the high-pressure cylinder will also become pressurized. Test data reveals that once a leaky valve has been found in a given cylinder head, there tends to be a likelihood that the remaining valves associated with that cylinder head will also require replacement. Thus, assuming the outlet valve 52 of the high-pressure cylinder is found to be leaky, one would replace the cylinder head for that cylinder. This is a relatively straightforward servicing operation that may be performed without removing the entire compressor from the locomotive. As described in the context of Tests 1A and 1B, monitoring whether there is airflow through the oil-fill port may point to a leak in the high-pressure cylinder head, such as air leaking by the respective high-pressure piston rings and into the crankcase. Once again being able to determine different failure modes is significant since different course of actions will be taken depending on the specific malfunction or failure mode that has been identified. For example, replacement of the aftercooler 16 and/or the high-pressure cylinder head including the respective intake and outlet valves 50 and 52 may be performed at the locomotive whereas a cylinder leak into the crankcase will require removal and shipping of the compressor for overhaul at a specialized compressor service site.

TEST 3—(Crankcase Pressure Test):

1. Remove test fixture from aftercooler discharge outlet.
2. Install pressurizing fixture at oil fill port.
3. Pressurize to a predefined pressure, e.g., 10 psi, and start to measure time, e.g., start a timer.
4. Compare the actual elapsed time recorded at the predefined pressure levels relative to one or more predefined threshold times, e.g., at 9, 8, 7, 6, 5, 4, 3 and 2 psi pressure.

This test primarily allows determining the health of the crankcase seals 21 and 23. In one exemplary embodiment, with the motor 17 installed, physical access to the end of the crankshaft where seal 23 is situated is not realizable. Thus, by pressurizing the crankcase and monitoring a depressurization rate and comparing to a predefined threshold, (e.g., if the elapsed time to reach 2 psi is approximately 60 seconds), one may obtain an indication of crankcase seal health without having to remove the compressor motor.

Referring back to FIG. 1, air dryer equipment 60 may be connected to remove moisture and/or other particulates that may be present in the compressed air to avoid condensation and/or contamination on the surfaces of one or more locomotive equipment (not shown) situated downstream that receive the pressurized air. In one known exemplary embodiment, the dryer equipment may comprise adsorbent-type air dryer that uses a regenerative desiccant that adsorbs moisture, at least up to a certain level of adsorption capacity. The moisture accumulated by the desiccant is then removed via a stream of dried air redirected through the desiccant to purge the moisture into the atmosphere. In one known technique, the air dryer equipment is responsive to a timer signal so that the regeneration process is performed at a fixed interval, (e.g., approximately every 2 minutes) regardless of actual usage of compressed air by the equipment downstream. This known technique forces the air compressor system to turn on and off based on the fixed timing for regeneration regardless of the actual consumption of compressed air by the locomotive equipment downstream.

The inventor of the present invention has innovatively recognized that a flowmeter 62 may be coupled to provide a signal indicative of the flow rate and/or pressure of the compressed air passing therethrough to a controller 64. The flow rate may be mathematically integrated over a period of time to calculate the actual volume of compressed air passing through the flowmeter 62. A memory or look-up table 66 may be used to compare the volume of compressed air actually used relative to a predefined volume for performing the regeneration process, as may be based on the adsorption capacity of the desiccant. Once the volume of compressed air actually used equals or exceeds the predefined volume for performing regeneration, then a regeneration signal would be sent by controller 64 to the dryer equipment to perform the regeneration process. That is, in lieu of regenerating at a fixed time interval, one would regenerate based on the actual depletion of pressurized air, as may be actually depleted by the equipment downstream supplied by the air compressor system.

The inventor of the present invention has further recognized that the flow meter 62 may be used to monitor degradation in the air compressing ability of the air compressor system. For example, the air compressor may be rated to supply a volume of compressed air within a predefined range at a predefined pressure. For example, in one exemplary embodiment, the compressor may be rated to deliver pressurized air in a range from approximately 145 cfm to approximately 180 cfm at a pressure of about 140 psi. As the air compressor ages, the ability to compress air will be gradually diminished, and it is thus desirable to determine whether the air compressor is able to pressurize air within an acceptable range. It is further contemplated that one could, based on past and present air compressing capacity, predict a future point in time when the air-compressing ability of the compressor system may be unacceptable. One may collect data from field-deployed air compressors and/or analytically or empirically derived data to extrapolate in time the present compressing ability of a given compressor to predict the point in time at which the compressing ability of the given compressor may no longer be acceptable so as to perform appropriate maintenance for that given compressor before reaching an unacceptable level of performance. For example, one may collect and store historical data from a plurality of air compressors like the one undergoing inspection to establish reference data for comparing actual data from the compressor undergoing inspection to predict the point in time when that compressor is likely to require a comprehensive servicing action, e.g., compressor overhaul. This data may be collected and stored on a suitable memory device and the data may be downloaded either during a servicing operation at a locomotive service site, or the data may be transmitted by communications equipment onboard the locomotive to a remote diagnostics center. One exemplary sequence for determining air-compressing capacity may be as follows:

Air Compressing Capacity Test

1. Run air compressor for a predefined amount of time (e.g., 30 minutes) with the compressor motor at a predefined first rpm (e.g., 600 rpm).
2. Hold the pressure at a predefined pressure (e.g., 140 psi).
3. Monitor parameters indicative of reaching a set of predefined operational conditions, an example of such parameters may be lubrication oil temperature and oil pressure.
4. At this point, one may optionally monitor intercooler pressure. This monitoring rechecks and verifies appropriate functionality of the high- and low-pressure heads of the compressor system, such as a leaky valve or a valve stuck closed. In one exemplary embodiment, it has been demonstrated that an intercooler pressure measurement of approximately 45 psi is generally indicative of appropriate functionality of both the high- and low-pressure cylinder heads of the compressor system. In this embodiment, an intercooler pressure measurement below 40 psi is generally indicative of a malfunction regarding the low-pressure heads. Conversely, an intercooler pressure measurement above 55 psi is generally indicative of a malfunction regarding the high-pressure heads. It will be appreciated that this option essentially allows requalifying the appropriate functionality of the high- and low-pressure heads of the compressor system. It will be further appreciated that the foregoing numerical values just represent illustrative values since such values can vary depending on the specific characteristics of the compressor system undergoing testing.

5. Use the signal from the flowmeter 62 to calculate volume of pressurized air actually supplied by the compressor.
6. Run air compressor for a predefined amount of time (e.g., 10 minutes) with the compressor motor at a second rpm (e.g., 1050 rpm) and repeat steps 2-4 above.
7. Compare actual volume of pressurized air delivered by the compressor relative to a predefined air volume range indicative of whether the capacity of the compressor to deliver pressurized air is acceptable or not.

Figures 2, 2A:
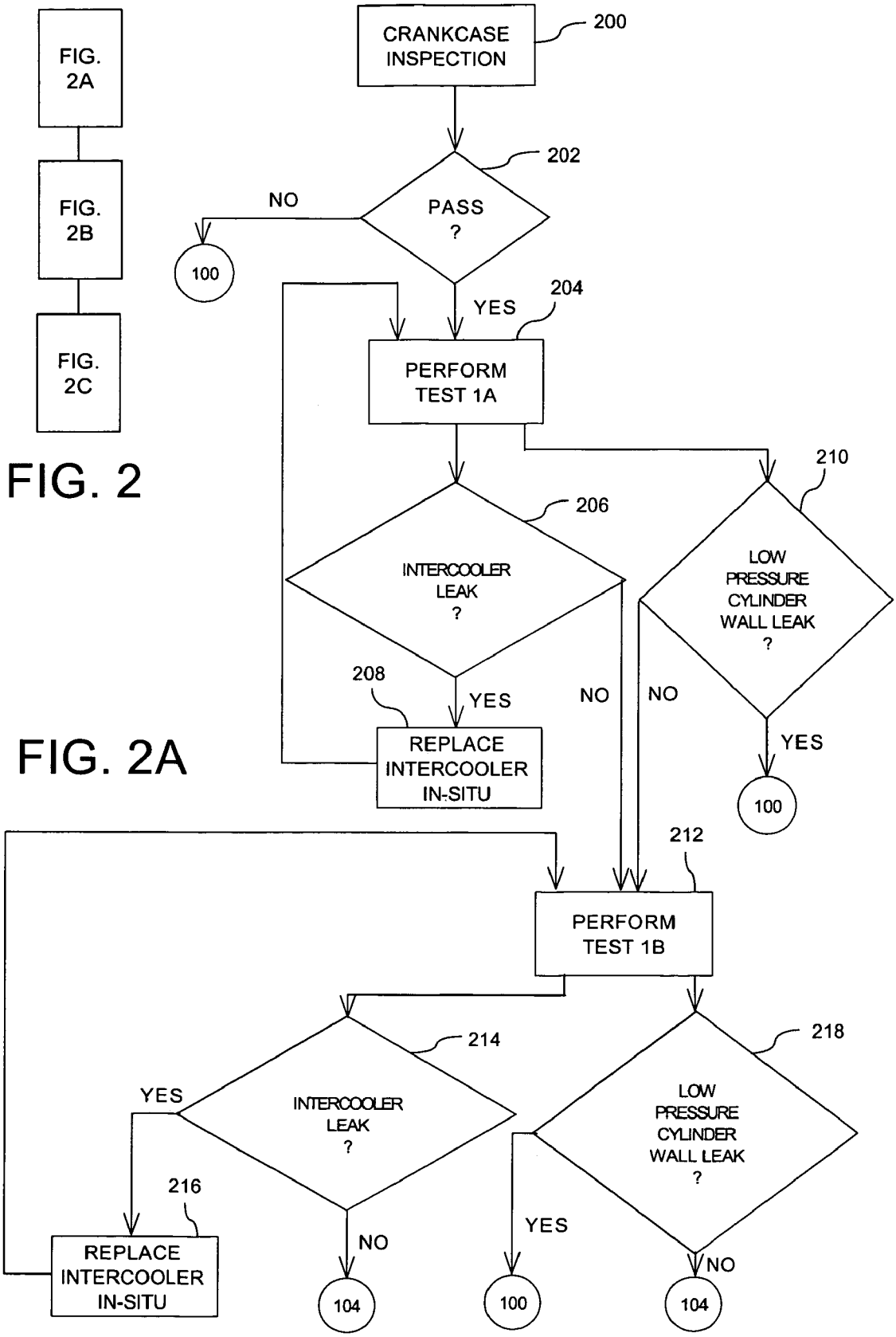
FIG. 2 is made up of FIGS. 2A-2C that collectively depicts a flow chart that illustrates an exemplary sequence of tests that may be performed on the air compressor system of FIG. 1 for identifying malfunctioning components while the system remains onboard the locomotive.
Figure 2B:
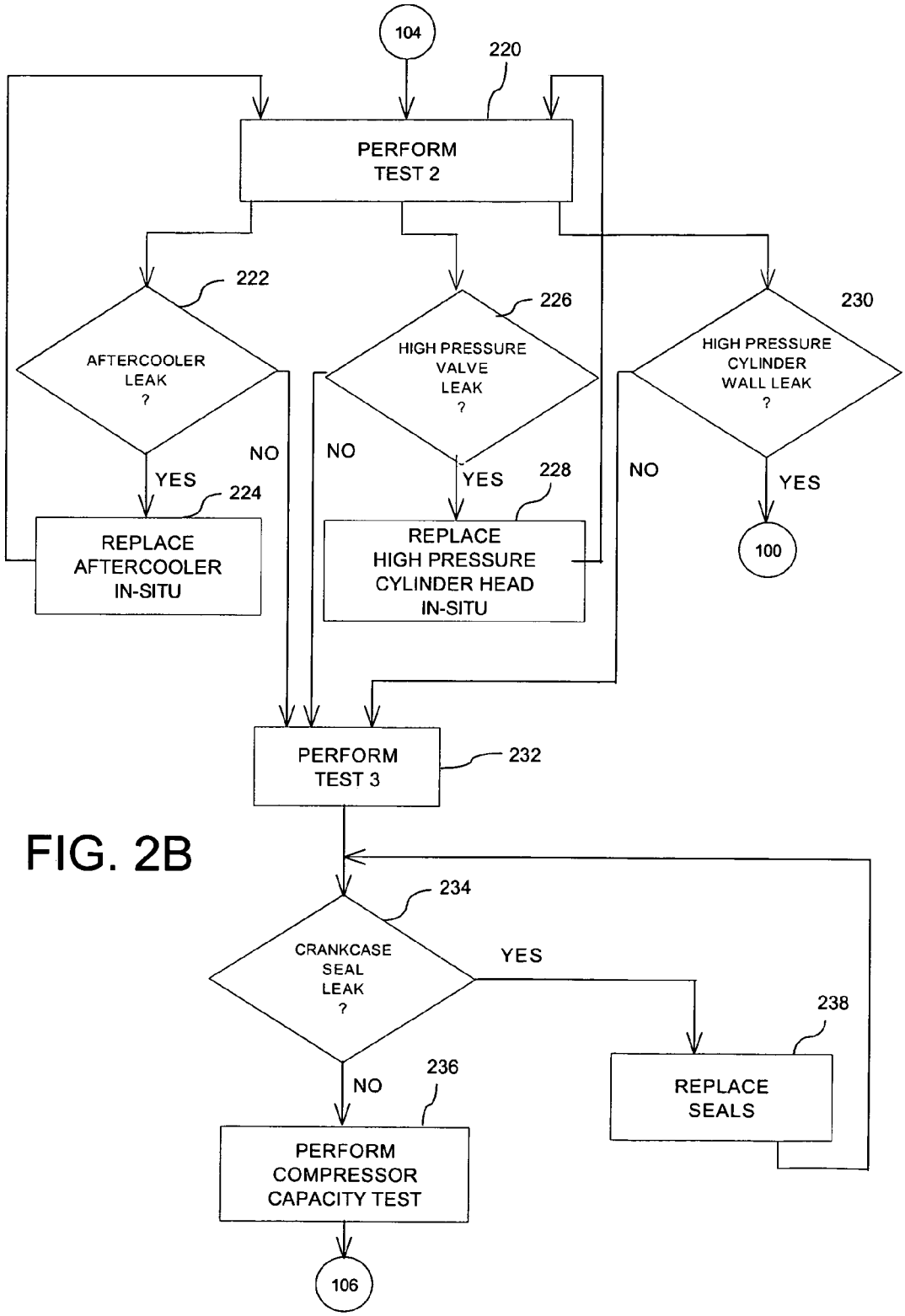
Figure 2C:
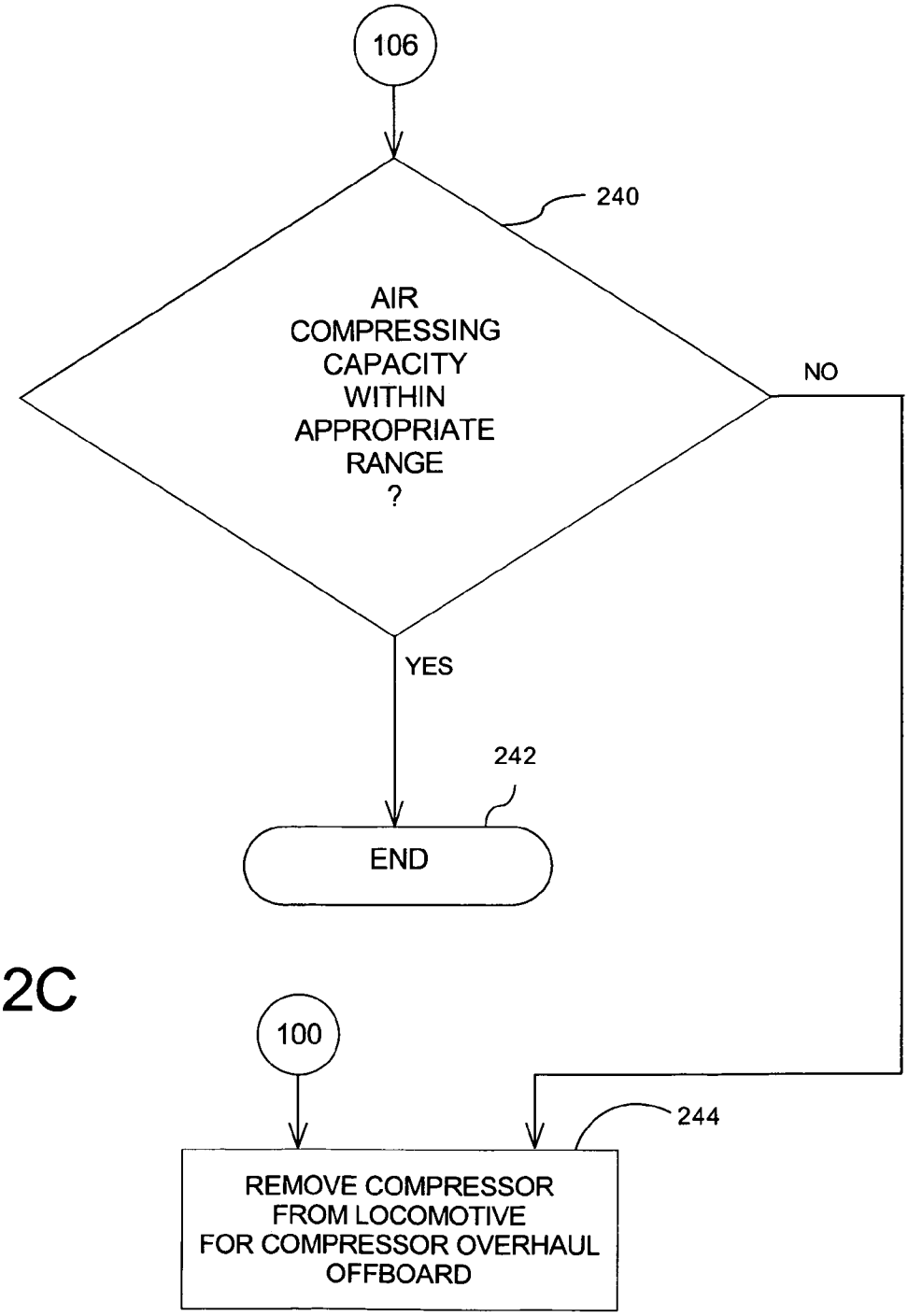

FIG. 2 is a flow chart of a sequence of tests embodying aspects of the present invention for performing diagnostics of an air compressor system on board a locomotive. In one exemplary sequence, as illustrated at block 200, one may initially perform crank case inspection to determine the health of mechanical components within the interior of the crankcase. As shown at decision diamond 202, if the crank case inspection is not passed then, as shown at block 244, the corrective action would be to remove the compressor from the locomotive for compressor overhaul at a specialized service site. If the crank case inspection test is passed one proceeds to block 204 to perform Test 1A, that is pressurizing the intercoolers and one of the two lower pressure cylinders. As shown at decision diamond 206, if an intercooler leak is detected, as shown at block 208, one proceeds to replace the leaking intercooler in-situ. To verify that the intercooler leak has been corrected, one would return to block 204 and repeat Test 1A. As shown at decision diamond 210, another possible failure mode that may be detected while performing Test 1A is detecting a low-pressure cylinder wall leak. If a low-pressure cylinder wall leak is detected, one proceeds through connecting node 100 to block 244 to remove the compressor from the locomotive for compressor overhaul at a specialized service site.

Presuming that no intercooler leak or low pressure cylinder wall leak has been detected, one continues at block 212 to perform Test 1B. That is, pressurizing the intercoolers and the other one of the low-pressure cylinders. As shown at decision diamond 214, if an intercooler leak is detected, as shown at block 216, one proceeds to replace the leaking intercooler in-situ. To verify that the intercooler leak has been corrected, one would return to block 212 and repeat Test 1B. As shown at decision diamond 218, another possible failure mode that may be detected while performing Test 1B is detecting a low-pressure cylinder wall leak. If a low-pressure cylinder wall leak is detected, one proceeds through connecting node 100 to block 244 to remove the compressor from the locomotive for compressor overhaul at a specialized service site. Presuming that no intercooler leak or low-pressure cylinder wall leak has been detected, one continues at block 220 to perform Test 2. That is, aftercooler and high-pressure cylinder test. One of the possible failure modes that may be diagnosed while performing Test 2, as shown at decision diamond 222, is an aftercooler leak. In the event of an aftercooler leak at block 224, one proceeds to replace the aftercooler in-situ. To verify that the aftercooler leak has been corrected, one would return to block 220 and repeat Test 2. As shown at decision diamond 226, another possible failure mode that may be detected while performing Test 2 is a malfunctioning high-pressure valve, e.g., a malfunctioning intake high-pressure valve. If a malfunctioning high-pressure valve is detected, then one proceeds to block 228 to perform a corrective action in-situ, such as replacing the high-pressure cylinder head assembly. To verify that the high-pressure valve malfunction has been corrected one may return to block 220 to restart Test 2. As shown at decision diamond 230, a third possible failure mode that may be detected while performing Test 2 would be to detect a high-pressure cylinder wall leak. If such a high-pressure cylinder wall leak is detected, one proceeds through connecting node 100 to block 244 to remove the compressor from the locomotive for compressor overhaul at the specialized service site.

Once Test 2 has been successfully passed, one proceeds to block 232 to perform Test 3. That is, the crankcase pressurization test. As shown at decision diamond 234, in the event no crankcase seal leak is detected, one then proceeds to block 236 to perform the air compressing capacity test. In the event a crank case seal leak is detected, one proceeds to block 238 to replace the crankcase seals. As shown at decision diamond 240, if the air compressing capacity is determined to be within an appropriate range of volume of pressurized air this would be the end of the test sequence as shown at block 242. If the air compressing capacity is unacceptable, then one proceeds to block 244 to remove the compressor from the locomotive for a compressor overhaul servicing.

Aspects of the present invention can also be embodied as computer readable code on a computer readable medium. The computer readable medium may be any data storage device that can store data, which thereafter can be read by a computer system. Examples of computer readable medium include read-only memory, random-access memory, CD-ROMs, DVDs, magnetic tape, optical data storage devices. The computer readable medium may also be distributed over network coupled computer systems so that the computer readable code is stored and executed in a distributed fashion.

Based on the foregoing specification, aspects of the present invention may be implemented using computer programming or engineering techniques including computer software, firmware, hardware or any combination or subset thereof. Any such resulting program, having computer-readable code means, may be embodied or provided within one or more computer-readable media, thereby making a computer program product, i.e., an article of manufacture, according to aspects of the invention. The computer readable media may be, for example, a fixed (hard) drive, diskette, optical disk, magnetic tape, semiconductor memory such as read-only memory (ROM), etc., or any transmitting/receiving medium such as the Internet or other communication network or link. The article of manufacture containing the computer code may be made and/or used by executing the code directly from one medium, by copying the code from one medium to another medium, or by transmitting the code over a network.

An apparatus for making, using or selling the invention may be one or more processing systems including, but not limited to, a central processing unit (CPU), memory, storage devices, communication links and devices, servers, I/O devices, or any sub-components of one or more processing systems, including software, firmware, hardware or any combination or subset thereof, which embody the invention as set forth in the claims.

User interface may be provided by way of keyboard, mouse, pen, voice, touch screen, or any other means by which a human can interface with a computer, including through other programs such as application programs.

While the preferred embodiments of the present invention have been shown and described herein, it will be obvious that such embodiments are provided by way of example only. Numerous variations, changes and substitutions will occur to those of skill in the art without departing from the invention herein. Accordingly, it is intended that the invention be limited only by the spirit and scope of the appended claims.

I claim as my invention:

1. A method for identifying one or more malfunctions from a plurality of malfunctions that can occur in a locomotive air compressing system comprising a plurality of components, with at least some of said plurality of malfunctions being correctable onboard a locomotive, said at least some malfunctions constituting onboard serviceable malfunctions, while a remaining of said plurality of malfunctions are correctable with the air compressing system being uninstalled and serviced at an off-board servicing site, said remaining malfunctions constituting off-board serviceable malfunctions, said method comprising:

performing a test sequence configured to isolate components of the air compressing system from one another to identify a component subject to a malfunction;

applying a pressurizing stimuli to the isolated components;

monitoring a response indicative of a malfunction type, the malfunction type being associated with one of the following: a corrective action to be performed onboard the locomotive, and a corrective action to be performed off-board the locomotive; and performing the corrective action appropriate for the malfunction type.

2. The method of claim 1 further comprising performing a crankcase inspection prior to performing said test sequence, and determining whether or not predefined criteria for passing said crankcase inspection is met, and, if said crankcase inspection meets the predefined passing criteria, proceeding to perform the test sequence.

3. The method of claim 1 wherein said air compressor system comprises a high-pressure stage and a low-pressure stage and performing the test sequence comprises isolating the low-pressure stage from the high-pressure stage to identify a malfunction likely to correspond to a respective one of said stages.

4. The method of claim 3 wherein said low-pressure stage comprises at least one low-pressure cylinder and at least one intercooler coupled to the low-pressure cylinder and wherein the applying of the pressurizing stimuli comprises pressurizing through an inlet port said least one low-pressure cylinder and said at least one intercooler.

5. The method of claim 4 wherein the monitoring of a response indicative of a malfunction type comprises monitoring a depressurization rate of the pressurized said at least one low-pressure cylinder and said at least one intercooler.

6. The method of claim 5 further comprising comparing the monitored depressurization rate relative to a predefined depressurization rate limit, and identifying a likely malfunction type based on the results of said comparison.

7. The method of claim 4 wherein the monitoring of a response indicative of a malfunction type comprises visually monitoring said at least one intercooler to detect an air leak in the intercooler, and, in the event said intercooler air leak is identified, replacing said intercooler onboard the locomotive.

8. The method of claim 4 wherein the monitoring of a response indicative of a malfunction type comprises monitoring air flow through an oil-filling port in a crankcase, and wherein a sensing of said air flow is indicative of a leak through a wall of said at least one low-pressure cylinder, and, in the event said air flow is sensed, performing a compressor removal from the locomotive for performing a compressor overhaul at the specialized servicing site.

9. The method of claim 3 wherein said high-pressure stage comprises a high-pressure cylinder and an aftercooler coupled to the high-pressure cylinder and wherein the applying of a pressurizing stimuli comprises pressurizing through an outlet port said high-pressure cylinder and said aftercooler.

10. The method of claim 9 wherein the monitoring of a response indicative of a malfunction type comprises monitoring a depressurization rate of the pressurized high-pressure cylinder and aftercooler.

11. The method of claim 10 further comprising comparing the monitored depressurization rate relative to a predefined depressurization rate limit, and identifying a likely malfunction type based on the results of said comparison.

12. The method of claim 9 wherein the monitoring of a response indicative of a malfunction type comprises visually monitoring said aftercooler to detect an air leak in the aftercooler, and, in the event said aftercooler air leak is detected, replacing said aftercooler onboard the locomotive.

13. The method of claim 9 wherein the monitoring of a response indicative of a malfunction type comprises monitoring air flow through an oil-filling port in a crankcase, a sensing of said air flow being indicative of a leak through a high-pressure cylinder wall, and, in the event said air flow is sensed, performing a compressor removal from the locomotive for performing a compressor overhaul at the specialized servicing site.

14. The method of claim 9 wherein the monitoring of a response indicative of a malfunction type comprises sensing air flow through an intake port of the high pressure cylinder, a sensing of said air flow being indicative of a leak through a high-pressure cylinder wall being indicative of at least one malfunctioning valve in the high pressure cylinder, and, in the event said air flow is sensed, performing a cylinder head replacement onboard the locomotive for the high pressure cylinder.

15. The method of claim 1 wherein the applying of pressurizing stimuli comprises pressurizing a crankcase and the monitoring of a response indicative of a malfunction type comprises monitoring a depressurization rate of the pressurized crankcase, said crankcase pressurizing and monitoring avoiding removal of a compressor motor for gaining visual access to crankcase seals wherein leakage is likely to develop.

16. The method of claim 1 wherein the applying of pressuring stimuli comprises energizing a compressor motor at a predefined RPM and monitoring a volume of pressurized air actually delivered by said compressor system over a period of time, and comparing the volume of pressurized air delivered by the compressor system relative to a predefined range indicative of whether or not said air compressor system meets a specified air-compressing capability.

17. The method of claim 16 further comprising monitoring an intercooler pressure and comparing said intercooler pressure relative to predefined pressure values to determine occurrence of a likely malfunction in one of the following: a cylinder head of a high-pressure stage and cylinder heads of a low-pressure stage of said compressor system.

18. A method for identifying one or more malfunctions from a plurality of malfunctions that can occur in a vehicular air compressing system comprising a plurality of components, with at least some of said plurality of malfunctions being correctable onboard a self-propelled vehicle, said at least some malfunctions constituting onboard serviceable malfunctions, while a remaining of said plurality of malfunctions are correctable with the air compressing system being uninstalled and serviced at an off-board servicing site, said remaining malfunctions constituting off-board serviceable malfunctions, said method comprising:

performing a test sequence configured to isolate components of the air compressing system from one another to identify a component subject to a malfunction;

applying a pressurizing stimuli to the isolated components;

monitoring a response indicative of a malfunction type, the malfunction type being associated with one of the following: a corrective action to be performed onboard the vehicle, and a corrective action to be performed off-board the vehicle; and performing the corrective action appropriate for the malfunction type.

* * * * *